United States Patent [19]

VanOmmeren

[11] Patent Number: 5,034,071

[45] Date of Patent: Jul. 23, 1991

[54] PRILL FOR EMULSION EXPLOSIVES

[75] Inventor: Catharine VanOmmeren, Tamaqua, Pa.

[73] Assignee: Atlas Powder Company, Dallas, Tex.

[21] Appl. No.: 538,127

[22] Filed: Jun. 14, 1990

[51] Int. Cl.[5] ..... C06G 45/34

[52] U.S. Cl. ..... 149/7; 149/2; 149/21; 149/46

[58] Field of Search ..... 149/2, 7, 21, 46

[56] References Cited

U.S. PATENT DOCUMENTS

| | | | |
|---|---|---|---|
| 3,447,978 | 6/1969 | Bluhm | 149/2 |
| 3,640,697 | 2/1972 | Toops | 149/7 |
| 3,715,247 | 2/1973 | Wade | 149/21 |
| 3,765,964 | 10/1973 | Wade | 149/2 |
| 3,770,522 | 11/1973 | Tomic | 149/2 |
| 4,097,316 | 6/1978 | Mullay | 149/2 |
| 4,111,727 | 9/1978 | Clay | 149/2 |
| 4,141,767 | 2/1979 | Sudweeks et al. | 149/2 |
| 4,181,546 | 1/1980 | Clay | 149/21 |
| 4,294,633 | 10/1981 | Clay | 149/2 |
| 4,357,184 | 11/1982 | Binet et al. | 149/2 |
| 4,376,113 | 3/1983 | Suglia et al. | 424/34 |
| 4,401,490 | 8/1983 | Alexander et al. | 149/2 |
| 4,514,511 | 4/1985 | Jacques et al. | 502/8 |
| 4,534,809 | 8/1985 | Takeuchi et al. | 149/3 |
| 4,555,278 | 11/1985 | Cescon | 149/21 |
| 4,615,751 | 10/1986 | Smith | 149/2 |
| 4,678,524 | 7/1987 | Cranney et al. | 149/2 |
| 4,708,753 | 11/1987 | Forsberg | 149/2 |
| 4,772,308 | 9/1988 | Zurimendi et al. | 71/54 |
| 4,784,706 | 11/1988 | Ghosh et al. | 149/2 |
| 4,808,251 | 2/1989 | Ghosh et al. | 149/2 |
| 4,820,361 | 4/1989 | McKenzie | 149/2 |
| 4,822,433 | 4/1989 | Cooper et al. | 149/2 |
| 4,828,633 | 5/1989 | Forsberg | 149/2 |

*Primary Examiner*—Stephen J. Lechert, Jr.

*Attorney, Agent, or Firm*—Richards, Medlock & Andrews

[57] ABSTRACT

The invention is directed to a blended explosive composition containing an emulsifier which is a derivative of polyisobutylene succinic anhydride and a prill having an internal additive of a naphthalene sulfonate surfactant and an external coating which makes the prill compatible with the emulsifier.

18 Claims, No Drawings

PRILL FOR EMULSION EXPLOSIVES

TECHNICAL FIELD OF THE INVENTION

The invention relates to blended exposed compositions utilizing a derivative of polyisobutylene succinic anhydride as an emulsifier. Specifically, the invention relates to a blended explosive composition utilizing a polyisobutylene succinic anhydrive as an emulsifier and an oxidizer salt prill which is compatible with the emulsifier.

BACKGROUND OF THE INVENTION

Water-in-oil emulsion explosive compositions utilizing solid particulate ammonium nitrate ("AN") are known in the explosives industry. See U.S. Pat. Nos. 4,555,278; 4,111,727; and 4,181,546. Explosives consisting of a water-in-oil emulsion and oxidizer salt prills are known as "blended explosives" and have a high bulk density, good blasting energy and good water resistance. However, disadvantages involved in the use of blended explosives having particulate oxidizer salt relate to the blend's pumpability and stability. More importantly, the blend's stability relates directly to the explosive properties of the blend. Some known blends are difficult to handle, i.e., to pump or auger. Further, some blends must be handled immediately after blending because over a short period of time the emulsion destabilizes ("breaks") and becomes hard, thus making the blend unpumpable and undetonable. This is especially true for certain blended emulsions using prills having a particular type of internal additive. Specifically, prills having an internal additive of a naphthalene sulfonate surfactant present stability problems when used with blended explosives utilizing a certain type of emulsifier.

Derivatives of polyisobutylene succinic anhydride are known in the art as good water-in-oil emulsifiers. Specifically, water-in-oil emulsions utilizing derivatives of polyisobutylene succinic anhydride ("PIBSA") as an emulsifier exhibit good stability and are disclosed in U.S. Pat. Nos. 4,357,184; 4,708,753; 4,784,706; 4,822,433; 4,828,633; 4,820,361 and E.P. No. 0 331 430. Atlas Powder of Tamaqua, Pennsylvania, produces water-in-oil emulsions utilizing PIBSA derivatives as emulsifiers and sells them under the tradenames APEX® and POWERMAX®.

To obtain sufficient detonation velocity, it is important to provide a readily deliverable oxygen source in the explosive composition. Oxidizer salts are the most widely used source of readily deliverable oxygen for explosive compositions. For example, ammonium nitrate is a common oxidizer salt used in the industry. Ammonium nitrate is made from anhydrous ammonium and nitric acid, and is produced in forms ranging from crystals to porous agglomerates known as prills. The present invention is directed to blended explosive compositions utilizing oxidizer salts in prill form. Generally, oxidizer salt prills used in blended explosives are made by spraying a solution of the salt against a countercurrent stream of air in a prilling tower. Particles of the oxidizer salt are formed. These particles are dried and then coated to improve flow characteristics and moisture resistance. Not only have prill coatings been applied after the prill is formed, but prills have also been developed which include internal additives used during the prilling process to produce a high-quality prill. See U.S. Pat. No. 4,749,349 to Kaltenbach-Thuring, S.A.

Typical external coatings for prills are binary, that is, one chemical is used to help a second chemical adhere to the surface of the prill. For example, usually an organic surfactant is used to help clay or talc adhere to the prill. The clay or talc acts as a "parting agent" and/or "anti-caking agent" to reduce caking and clumping of the prills. Caking and clumping of prills before blending with the emulsion is a common problem in the explosives industry and it occurs more frequently in the summer months during high humidity conditions.

Organic surfactants are known in the industry as coatings for prills so that clay or talc can adhere thereto. See EP 8900923.2. For example, such an organic surfactant in the general chemical class of naphthalene sulfonates is sold under the trade name GALORYL AT 4045 by Lobeco Products, Inc. of Beaufort, S.C. to help clay or talc adhere to prills. GALORYL AT 4045 has a specific gravity of 1.110 (water =1), is soluble in water, has a boiling point of 212° F., melting point, i.e., liquid freezes at 32° F., a vapor pressure of 17.5 mmHg (at 20° C.), and a vapor density of 0.6 (air =1).

The recent introduction of prills made by the Kaltenbach-Thuring process, U.S. Pat. No. 4,749,349 ("KT prills"), which include an internal additive of a naphthalene sulfonate surfactant and an external coating of a naphthalene sulfonate surfactant have caused stability problems in blends of this particular prill and certain water-in-oil emulsions.

A prill having an internal additive of a naphthalene sulfonate surfactant and an external coating of a naphthalene sulfonate surfactant produces a prill of good quality having low moisture content and low fines content. Further, the use of a naphthalene sulfonate surfactant during the prilling process not only provides a prill of high quality but reduces production costs substantially. Due to the above qualities, these prills represent an advancement over other prills known in the art. However, it has been found that these prills which include a naphthalene sulfonate surfactant destabilize blended emulsions which utilize derivatives of polyisobutylene succinic anhydride ("PIBSA-type") as an emulsifier. Specifically, the naphthalene sulfonate surfactant of the prill interferes with the water-in-oil emulsion structure and causes the emulsion to break, thus making the emulsion difficult to handle. Further, as a result of the interference, the blend may not be detonable. While removing the external coating of the prill improves the stability of the blended emulsion it does not provide a practical solution since the uncoated prills cake making it difficult, if not impossible, to blend the prills with the water-in-oil emulsion.

Therefore, there is a need to provide a coating for prills having a naphthalene sulfonate surfactant as an internal additive which is compatible with blended explosive compositions utilizing derivatives of polyisobutylene succinic anhydride as an emulsifier.

SUMMARY OF THE INVENTION

In one aspect, the present invention relates to a blended explosive composition comprising a water-in-oil emulsion utilizing a derivative of polyisobutylene succinic anhydride as an emulsifier and an oxidizer salt prill which is compatible with the emulsifier.

Another aspect of the invention relates to coated prills to be used in blended explosive compositions. The prill of the invention is compatible with a water-in-oil emulsion which is made from a water-immiscible organic fuel as a continuous phase, an emulsified aqueous inorganic oxidizer salt solution as a discontinuous phase, and an emulsifier which is a derivative of polyisobutylene succinic anhydride. The emulsion can also contain density reducing agents such as glass or resin microspheres, expanded perlite, entrained gas, or the like.

The prill of the present invention is a prill having an internal additive of a naphthalene sulfonate surfactant and a coating which is compatible with PIBSA-type emulsifiers.

DETAILED DESCRIPTION

The prill of the present invention is useful in blended explosive compositions, which are typically comprised of: an oxidizer solution, immiscible organic fuel, and an emulsifier which is a derivative of polyisobutylene succinic anhydride ("PIBSA-type"). The emulsion can also contain density reducing agents.

Immiscible organic fuel forms the continuous phase of the emulsion and is present in an amount of from about 3% to about 12%, and preferably in an amount from about 4% to about 8% by weight of the composition. The actual amount used can be varied depending upon the particular immiscible fuel(s) and upon the presence of other fuels, if any. The immiscible organic fuels can be aliphatic, alicyclic, and/or aromatic, and can be saturated and/or unsaturated, so long as they are liquid at the formulation temperature. Preferred fuels include tallow oil, mineral oil, waxes, paraffin oils, benzene, toluene, xylenes, mixtures of liquid hydrocarbons generally referred to as petroleum distillates such as gasoline, kerosene and diesel fuels, ingestible oils such as corn oil, cottonseed oil, peanut oil, and soybean oil. Preferred fuels are mineral oil, #2 diesel fuel oil, paraffin waxes, microcrystalline waxes, and mixtures thereof. Particularly preferred in the practice of the present invention is low viscosity mineral oil. Aliphatic and aromatic nitro compounds can also be used. As known in the art, mixtures of two or more of the above can also be used.

The inorganic oxidizer salt solution forms the discontinuous phase of the emulsion and is generally comprised of inorganic oxidizer salt in an amount from about 45% to about 95% by weight of the total composition and water, and/or water-miscible organic liquids, in an amount of from about 2% to about 30%. The oxidizer salt preferably is primarily ammonium nitrate, but other salts may be used. The other oxidizer salts may be used in amounts of up to about 40% by weight. Preferably, the other oxidizer salts are present in an amount of up to about 20% by weight. The other oxidizer salts are selected from the group consisting of ammonium, alkali and alkaline earth metal nitrates, and perchlorates and the like. From about 10% to about 90% of the total oxidizer salt may be added in particle or prill form. As is known in the art, the amount of oxidizer salt present in prill form can vary depending upon desired properties for particular applications.

Water generally is employed in an amount of from about 2% to about 30% by weight based on the total composition. It is preferably employed in an amount of from about 10% to about 20%. Water-miscible organic liquids can partially replace water as a solvent for the salts, and such liquids also function as a fuel for the composition. Further, certain water-miscible organic liquids reduce the crystallization temperature of the oxidizer salts in solution. Miscible organic liquids useful in the practice of the present invention include alcohols such as methyl alcohol, glycols such as ethylene glycols, amides such as formamide, and analogous nitrogen containing liquids. As is well known in the art, the amount and type of water or water-miscible organic liquid(s) used can vary according to desired properties.

Emulsifiers used in the present invention are derivatives of polyisobutylene succinic anhydride ("PIBSA-type") and preferably are used in an amount of from about 0.2% to about 5%. For example, condensation products of an amine and poly[alk(en)yl]succinic acid and/or anhydride may include esters, imides amides, and mixtures thereof. Preferably, said emulsifier has an average molecular weight in the range 400 to 5000.

In said poly[alk(en)yl]succinic acid-based emulsifier it is preferred that the hydrocarbon chain is derived from polymerization of a mono-olefin and generally the polymer chain will contain from 40 to 500 carbon atoms.

Preferably the poly[alk(en)yl]moiety is derived from olefins containing from 2 to 8 carbon atoms and in particular from ethylene, propylene, i-butene and isobutene. The emulsifier may be derived from poly[alk(en-)yl]succinic anhydride. Such emulsifiers derivatives are disclosed in Australian Patent, Patent Application No. 40008/85.

Such derivatives are commercially-available materials which are made by an addition reaction between a polyolefin containing a terminal unsaturated group and maleic anhydride, optionally in the presence of a halogen containing catalyst. The succinic acid or anhydride residue in the above compounds may be reacted to introduce a polar group. Generally the said polar group is monomeric although oligomeric groupings containing not more than about 10 repeat units may be employed. Examples of suitable polar groups may include polar groups derived from polyols such as glycerol, pentaerythritol, and sorbitol or an internal anhydride thereof (e.g. sorbitan); from amines such as ethylene diamine, tetraethylene triamine and dimethylaminopropylamine; and from heterocyclics such as oxazoline or imidazoline. Suitable oligomeric groupings include short-chain poly(oxyethylene) groups (i.e. those containing up to 10 ethylene oxide units).

Formation of emulsifiers for use in accordance with the invention may be effected by conventional procedures depending upon their chemical nature.

In order to prepare a derivative of poly(alk(en)yl)succinic acid comprising a polar group derived from an alcohol or amine, the acid group or anhydride thereof can be caused to react with the hydroxyl or amino group by heating the two components together in a suitable solvent, in the presence of a catalyst if desired.

The emulsifiers may be of a non-ionic character, but they may alternatively be anionic or cationic in nature, as, for example, where the hydrophilic moiety incorporates the residue of a polyamine or a heterocyclic compound.

Preferred emulsifiers are poly(isobutylene) succinic anhydride derivatives and most preferably condensates thereof with amines such as ethanolamine. As is known in the art, mixtures of the above PIBSA-type emulsifier with other non-PIBSA-type emulsifiers may be employed in the practice of the present invention.

Depending upon the ratio of prills to emulsion, the emulsion component may or may not contain density reducing agents. For example, when the blend contains less than about 40% emulsion, the emulsion may, but need not contain density reducing agents. For blends containing over about 55% emulsion, the emulsion component should generally contain a density reducing agent to attain proper performance. For blends having between 40% to 55% emulsion, it is generally preferred to use a density reducing agent to achieve the desired performance.

The emulsion components useful in the practice of the present invention can be reduced from their natural densities by addition of density reducing agents such as glass microspheres in an amount sufficient to preferably reduce the density to within the range of from about 1.0 g/cc to about 1.4 g/cc. Of course, as known in the art the density of the emulsion can be varied depending upon the desired properties for a particular application. Other density reducing agents that can be used alone or in combination include perlite and chemical gassing agents, such as sodium nitrite, which decomposes chemically in the composition to produce gas bubbles, mechanical aeration and/or other means of entraining density reducing agents.

Generally, water-in-oil emulsions used in the explosives industry are prepared by dissolving ammonium nitrate in water at elevated temperatures from about 25° C. to about 90° C. to form a discontinuous phase. The discontinuous phase is then mixed with a continuous phase which is comprised of immiscible organic fuel and an emulsifier(s). The two phases are mixed using high-shear mixing to form an emulsion. To this emulsion, density reducing agents can be added if desired. The formulation process can also be performed in a continuous manner as known in the art.

To form the blended emulsion of the present invention, the above-described emulsion is blended with an oxidizer salt in prill form. Preferably, as stated, the salt is ammonium nitrate. While the examples are in terms of ammonium nitrate ("AN") prills, it is by no way meant to limit the application of the present invention to only AN prills.

The prills of the present invention contain an internal additive and an external coating. The internal additive of the prill of the present invention is a alkyl naphthalene sulfonate surfactant. Preferably, the prill of the present invention contains a naphthalene sulfonate surfactant sold by CFPI of France under the tradename of GALORYL AT725.

One example of the external coating of the prill of the present invention is comprised of a saturated lipid amine, organic acid and mineral oil. Further, the coating of the prill of the present invention is characterized by making the prill compatible with the blended emulsions utilizing PIBSA-type emulsifiers. This example of the prill coating is made by neutralizing the saturated lipid amine with organic acid. The neutralized saturated lipid amine is then mixed with mineral oil and is ready for use. Preferably, the coating is comprised of about 25% by weight neutralized saturated lipid amine and about 75% by weight hydrotreated mineral oil. A particularly preferred embodiment of the coating for the prill of the present invention is the surfactant sold under the trade name of Lilamine AC-59L, which is produced and sold by Berol Nobel Nacka, AB of Stockholm, Sweden. Lilamine AC-59L consists of a hydrogenated tallow amine neutralized with organic acid. The neutralized hydrogenated tallow amine is diluted with hydrotreated mineral oil. Lilamine AC-59L has a specific gravity, i.e., density of 7.39 lb/gal at 158° F. (water =1); a melting point of 126° F.; a boiling point of over 660° F.; an evaporation rate less than 1 (butyl acetate =1); a vapor pressure (mm Hg) of 50.1 at 212° F.; a vapor density greater than 1 (air =1); is insoluble in water (soluble in ethanol); and has a flash point (amount used) of over 300° F. cc.

Another example of the prill coating of the present invention is sorbitan monooleate. Sorbitan monooleate is a nonionic surfactant which is known in the art as a water-in-oil emulsifier. Sorbitan monooleate is sold by ICI Americas, Inc., under the tradename "Span 80."

It has been discovered that the use of the coating of the present invention to coat prills having an internal additive of a naphthalene sulfonate surfactant to be used in blended explosives utilizing a PIBSA-type emulsifier produces a blended emulsion that can be readily pumped or augered and that remains detonable for at least 12 weeks. Thus, a coating has been discovered for prills containing an internal additive of naphthalene sulfonate surfactant which is compatible with PIBSA-type emulsifiers. Compatibility tests are set forth below.

A compatibility test of eight different prills, in this case ammonium nitrate prills, was conducted to determine the specific prill's compatibility with an emulsion utilizing a PIBSA-type emulsifier. The emulsion used in the test was prepared as discussed above and contained the following: ammonium nitrate 75.5%, water 15.5%, low viscosity mineral oil 7%, PIBSA-type emulsifier 1%, and microspheres 1%.

Using the above emulsion formulation, the following ammonium nitrate prills were tested:

| Number Designation | Prill Description |
|---|---|
| 1 | GALORYL ® AT725 internal, GALORYL ® AT4045 external |
| 2 | GALORYL ® AT725 internal, no external |
| 3 | GALORYL ® AT725 internal, clay only external |
| 4 | aluminum sulfate internal, GALORYL ® AT4045 and clay external |
| 5 | aluminum sulfate internal, Petro ® Ag[a] and talc external |
| 6 | GALORYL ® AT725 internal, 0.5% Span 80 external |
| 7 | GALORYL ® AT725 internal, 0.5% Armoflo ® 66[b] external |
| 8 | GALORYL ® AT725 internal, 0.12% Lilamine AC-59L external |

[a]alkyl naphthalene sulfonate sold by Petrochemicals/DeSoto of Fort Worth, Texas under the tradename Petro ® Ag Special Powder
[b]a fatty amine sold by Akzo of Chicago, Illinois under the tradename Armoflo ® 66

Specifically, the compatiblity test used involved making a laboratory blend of emulsion (60% by weight) with 40% by weight prill that contained 4% #2 diesel fuel oil. The 60% emulsion blends were split up into two four-ounce samples in containers with securable airtight lids. One sample was retained at room temperature and the other sample was cycled between room temperature and 110° F. One cycle consists of 24 hours at 110° F. and 24 hours at room temperature (approximately 72° F.). Prior to returning the samples to the elevated temperature, the softness of the sample was checked using a cone penetyrometer made by Precision, Chicago, Ill. The values of softness of each sample are set forth in the chart below. These values are represented in millimeters. The larger the value, the softer the sample and thus representing a more stable emulsion. The smaller the value illustrates a less soft or harder emulsion which has to some extent broken and thus become destabilized.

| No. of Cycles | 1* | 2 | 3 | 4 | 5 | 6 | 7 | 8 | Field Test |
|---|---|---|---|---|---|---|---|---|---|
| 1 | 23.6 | 24.4 | 25.4 | 27.5 | 25.2 | 28.9 | 24.0 | 26.3 | 25.8 |
| 2 | 14.9 | 22.3 | 21.3 | 25.3 | 23.5 | 26.5 | 19.8 | 23.2 | 22.3 |
| 3 | 1.8 | 19.9 | 18.5 | 22.3 | 21.4 | 23.0 | 16.3 | 19.7 | 19.9 |
| 4 | | 17.5 | 14.6 | 20.4 | 20.3 | 18.9 | 13.4 | 17.5 | 17.3 |
| 5 | | 18.3 | 6.1 | 18.2 | 14.8 | 16.8 | 8.1 | 15.6 | 15.6 |
| 6 | | 13.9 | 2.7 | 15.9 | 15.1 | 11.7 | 6.2 | 12.5 | 12.6 |
| 7 | | 10.9 | | 13.6 | 12.5 | 7.3 | 3.7 | 10.4 | 7.9 |
| 8 | | 7.6 | | 8.9 | 9.4 | 3.8 | | 7.4 | 5.4 |
| 9 | | 6.8 | | 6.8 | 8.7 | | | 4.5 | 3.6 |
| 10 | | 4.4 | | 3.4 | 5.5 | | | | |

*Sample 1 values represent the average of three samples tested.

The above chart illustrates that the prill having an internal additive and an external coating of naphthalene sulfonate surfactant (Sample #1) is incompatible with the PIBSA-type emulsifier because the emulsion broke and became rock hard within three cycles. Sample #5 illustrates the performance of a prill which is sufficient in terms of field handling to be used in emulsions utilizing a PIBSA-type emulsifiers. Sample #5, however, is a prill with an internal additive of aluminum sulfate not a naphthalene sulfonate surfactant. Sample #2 illustrates that the removal of the external naphthalene sulfonate surfactant from Sample #1 solves the compatibility problem with the PIBSA-type emulsifier to some extent. However, Sample #2 is not commercially suitable due to the absence of an external coating to retard caking. The uncoated prills of Sample #2 cake making it difficult if not impossible to blend the prill with the emulsion. Sample #3 illustrates that the use of only clay externally does not produce a prill which is compatible with PIBSA-type emulsifiers. As shown, Sample #3 becomes hard within five cycles. Samples #6, #7 and #8 demonstrate that different coatings for the prills affect the compatibility of the prill with the PIBSA-type emulsifier. Samples #6 and #8 illustrate the coating of the present invention, which is compatible with the PIBSA-type emulsifier and does not become hard until seven or eight cycles.

As set forth in the test results, "compatible with the PIBSA-type emulsifier" means a coating for a prill having an internal additive of a naphthalene sulfonate surfactant wherein a blend of the coated prill and an emulsion utilizing a PIBSA-type emulsifier yields a blended emulsion explosive composition having a softness measured by a penetrometer of at least 10 after 6 cycles.

I claim:

1. A blended explosive composition comprising:
(a) from about 2% to about 30% by weight water;
(b) from about 2% to about 12% by weight organic fuel;
(c) from about 0.2% to about 5% by weight of a polyisobutylene succinic anhydride type-emulsifier;
(d) from about 0.5% to about 10% by weight density reducing agents; and
(e) from about 45% to about 95% by weight ammonium nitrate;
(f) from about 10% to about 90% of said ammonium nitrate being in prill form; and
(g) said ammonium nitrate prill comprising:
(i) an internal additive consisting of a napthalene sulfonate surfactant; and
(ii) an external coating compatible with the emulsifier.

2. The blended explosive composition of claim 1 wherein the external coating is comprised of a neutralized saturated lipid amine diluted with mineral oil 3. The blended explosive composition of claim 1 wherein the external coating is comprised of sorbitan monooleate.

4. A blended emulsion explosive composition comprising:
(a) from about 2% to about 30% by weight water;
(b) from about 3% to about 12% by weight organic fuel;
(c) from about 0.2% to about 5% by weight of a polyisobutylene succinic anhydride type-emulsifier;
(d) from about 0.5% to about 10% by weight density reducing agents; and
(e) from about 45% to about 95% by weight ammonium nitrate;
(f) from about 10% to about 90% of said ammonium nitrate being in prill form; and
(g) said ammonium nitrate prill having an internal additive of a naphthalene sulfonate surfactant and an external coating compatible with the emulsifier, said coating comprising:
(i) a saturated lipid amine;
(ii) an organic acid; and
(iii) mineral oil.

5. A blended explosive composition comprising:
(a) from about 2% to about 30% by weight water;
(b) from about 3% to about 12% by weight oil;
(c) from about 0.2% to about 5% by weight of a polyisobutylene succinic anhydride type-emulsifier;
(d) from about 0.5%.to about 10% by weight density reducing agents; and
(e) from about 45% to about 95% by weight ammonium nitrate;
(f) from about 10% to about 90% of said ammonium nitrate being in prill form; and
(g) said ammonium nitrate prill having an internal additive of a naphthalene sulfonate surfactant and an external coating of sorbitan monooleate compatible with the emulsifier.

6. A blended explosive composition comprising:
(a) a discontinuous phase consisting of ammonium nitrate and water;
(b) a continuous phase consisting of a organic fuel and a polyisobutylene succinic anhydride the emulsifier; and
(c) ammonium nitrate prills consisting of:
(i) an internal additive of a naphthalene sulfonate surfactant; and
(ii) an external coating compatible with the polyisobutylene succinic anhydride-type emulsifier comprised of:
(1) a saturated tallow amine;
(2) an organic acid; and
(3) mineral oil.

7. A blended explosive composition comprising:
(a) a discontinuous phase consisting of ammonium nitrate and water;
(b) a continuous phase consisting of a organic fuel and a polyisobutylene succinic anhydride-type emulsifier; and
(c) ammonium nitrate prills consisting of:

(i) an internal additive of a naphthalene sulfonate surfactant; and
(ii) an external coating compatible with the polyisobutylene succinic anhydride-type emulsifier comprised of sorbitan monooleate.

8. An ammonium nitrate prill to be used in blended explosive compositions, said blended compositions having a polyisobutylene succinic anhydride-type emulsifier, said prill comprised of:
(a) an internal additive consisting of a naphthalene sulfonate surfactant; and
(b) an external coating compatible with the polyisobutylene succinic anhydride-type emulsifier and comprised of: (i) a saturated lipid amine; (ii) an organic acid; and (iii) mineral oil.

9. An ammonium nitrate prill to be used in blended explosive compositions, said blended compositions having a polyisobutylene succinic anhydride-type emulsifier, said prill comprised of:
(a) an internal additive consisting of a naphthalene sulfonate surfactant; and
(b) an external coating comprised of sorbitan monooleate compatible with the polyisobutylene succinic anhydride-type emulsifier.

10. A blended explosive composition comprising:
(a) from about 2% to about 30% by weight water;
(b) from about 2% to about 12% by weight organic
(c) from about 0.2% to about 5% by weight of a polyisobutylene succinic anhydride type-emulsifier;
(d) from about 0.5% to about 10% by weight density reducing agents; and
(e) from about 45% to about 95% by weight oxidizer
(f) from about 10% to about 90% of said oxidizer salt being in prill form; and
(g) said oxidizer salt prill comprising:
(i) an internal additive consisting of a naphthalene sulfonate surfactant; and
(ii) an external coating compatible with the emulsifier.

11. The blended explosive composition of claim 10 wherein the external coating is a neutralized saturated lipid amine diluted in mineral oil.

12. The blended explosive composition of claim 10 wherein the external coating is sorbitan monooleate.

13. A blended explosive composition comprising:
(a) from about 2% to about 30% by weight water;
(b) from about 3% to about 12% by weight organic fuel;
(c) from about 0.2% to about 5% by weight of a polyisobutylene succinic anhydride type-emulsifier;
(d) from about 0.5% to about 10% by weight density reducing agents; and
(e) from about 45% to about 95% by weight oxidizer salt;
(f) from about 10% to about 90% of said oxidizer salt being in prill form; and
(g) said oxidizer salt prill having an internal additive of a naphthalene sulfonate surfactant and an external coating compatible with the emulsifier, said coating comprised of:
(i) a saturated lipid amine;
(ii) an organic acid; and
(iii) mineral oil.

14. A blended explosive composition comprising:
(a) from about 2% to about 30% by weight water;
(b) from about 3% to about 12% by weight organic fuel;
(c) from about 0.2% to about 5% by weight of a polyisobutylene succinic anhydride type-emulsifier;
(d) from about 0.5% to about 10% by weight density reducing agents; and
(e) from about 45% to about 95% by weight oxidizer salt;
(f) from about 10% to about 90% of said oxidizer salt being in prill form; and
(g) said oxidizer salt prill having an internal additive of a naphthalene sulfonate surfactant and an external coating compatible with the emulsifier, said coating comprised of sorbitan monooleate.

15. A blended explosive composition comprising:
(a) a discontinuous phase consisting of oxidizer salt and water;
(b) a continuous phase consisting of a organic fuel and a polyisobutylene succinic anhydride-type emulsifier; and
(c) oxidizer salt prills consisting of:
(i) an internal additive of a naphthalene sulfonate surfactant; and
(ii) an external coating compatible with the polyisobutylene succinic anhydride-type emulsifier comprised of:
(1) a saturated tallow amine;
(2) an organic acid; and
(3) mineral oil 16. A blended explosive composition comprising:
(a) a discontinuous phase consisting of oxidizer salt and water;
(b) a continuous phase consisting of a organic fuel and a polyisobutylene succinic anhydride-type emulsifier; and
(c) oxidizer salt prills consisting of:
(i) an internal additive of a naphthalene sulfonate surfactant; and
(ii) an external coating compatible with the polyisobutylene succinic anhydride-type emulsifier comprised of sorbitan monooleate.

17. A prill to be used in blended explosive compositions, said blended compositions having a polyisobutylene succinic anhydride-type emulsifier, said prill comprised of:
(a) an internal additive consisting of a naphthalene sulfonate surfactant; and
(b) an external coating compatible with the polyisobutylene succinic anhydride-type emulsifier, said coating comprised of: (i) saturated lipid amine; (ii) an organic acid; and (iii) mineral oil.

18. A prill to be used in blended explosive compositions, said blended compositions having a polyisobutylene succinic anhydride-type emulsifier, said prill comprised of:
(a) an internal additive consisting of a naphthalene sulfonate surfactant; and
(b) an external coating compatible with the polyisobutylene succinic anhydride-type emulsifier, said coating comprised of sor monooleate.

* * * * *

UNITED STATES PATENT AND TRADEMARK OFFICE

CERTIFICATE OF CORRECTION

PATENT NO. : 5,034,071

DATED : July 23, 1991

INVENTOR(S) : Catharine VanOmmeren

It is certified that error appears in the above-identified patent and that said Letters Patent is hereby corrected as shown below:

Column 1, line 10, delete "anhydrive" and insert therefore --anhydride--.

Column 4, line 22, delete "i-butene" and insert therefore --1-butene--.

Column 6, line 63, delete "penetyrometer" and insert therefore --penetrometer--.

Column 8, line 51, delete "the" after anhydride and insert ---type--.

Column 9, line 27, after "organic" insert --fuel;--.

Column 9, line 29, delete "anhydride type-emulsifier;" and insert --anhydride-type emulsifier;--.

Column 9, line 33, after "oxidizer" insert --salt;--.

Column 10, line 64, delete "sor" and insert therefore --sorbitan--.

Signed and Sealed this

Twenty-third Day of March, 1993

*Attest:*

STEPHEN G. KUNIN

*Attesting Officer*

*Acting Commissioner of Patents and Trademarks*